US008066045B2

(12) United States Patent
Sleiman

(10) Patent No.: US 8,066,045 B2
(45) Date of Patent: Nov. 29, 2011

(54) HAND LABELER

(75) Inventor: Joseph Z. Sleiman, Leamington (CA)

(73) Assignee: Joe & Samia Management Inc., Leamington, Ontario (CA)

( * ) Notice: Subject to any disclaimer, the term of this patent is extended or adjusted under 35 U.S.C. 154(b) by 163 days.

(21) Appl. No.: 12/521,086

(22) PCT Filed: Oct. 19, 2007

(86) PCT No.: PCT/CA2007/001850
§ 371 (c)(1),
(2), (4) Date: Nov. 11, 2009

(87) PCT Pub. No.: WO2008/046222
PCT Pub. Date: Apr. 24, 2008

(65) Prior Publication Data

US 2010/0051201 A1 Mar. 4, 2010

Related U.S. Application Data

(60) Provisional application No. 60/862,274, filed on Oct. 20, 2006.

(51) Int. Cl.
*B32B 37/00* (2006.01)

(52) U.S. Cl. ..... 156/351; 156/361; 156/378; 156/494; 156/577; 156/579

(58) Field of Classification Search ..... 156/350, 156/351, 361, 367, 368, 378, 384, 387, 574, 156/577, 579, 494
See application file for complete search history.

(56) References Cited

U.S. PATENT DOCUMENTS 4,561,926 A 12/1985 Hamisch et al.
(Continued)

FOREIGN PATENT DOCUMENTS

DE 3739421 6/1989
FR 2619079 2/1989

OTHER PUBLICATIONS

International Preliminary Report on Patentability, dated Apr. 22, 2009, for International Application No. PCT/CA2007/001850, filed Oct. 19, 2007.

(Continued)

*Primary Examiner* — James Sells
(74) *Attorney, Agent, or Firm* — Warner Norcross & Judd LLP

(57) ABSTRACT

A hand held labeler has a support liner wheel that is driven by a motor to accurately advance the label web, while providing adequate storage for the support liner of an entire label web. In one embodiment, the labeler includes a micro-controller that controls the motor to vary the speed of the support liner wheel to accommodate for the increased speed of the label web as the circumference of the support liner grows on the support liner wheel. The labeler also includes an applicator to separate the labels from the support liner. The applicator may include a trigger mechanism that is connected to the micro-controller to signal the micro-controller that a label has been placed on an item. The micro-controller may be programmed to start the motor upon receiving the signal from the trigger mechanism. In another embodiment, the support liner wheel is sized to accommodate the support liner of an entire label web, such that the support liner wheel does not need to be emptied or replaced before depositing all of the labels of a particular label web.

14 Claims, 5 Drawing Sheets

U.S. PATENT DOCUMENTS

| | | | | |
|---|---|---|---|---|
| 4,830,522 | A * | 5/1989 | Sato et al. | 400/621 |
| 4,956,045 | A | 9/1990 | Goodwin et al. | |
| 5,906,443 | A * | 5/1999 | Goodwin et al. | 400/73 |
| 6,712,112 | B2 * | 3/2004 | Goodwin et al. | 156/577 |
| 2005/0061450 | A1 | 3/2005 | Petitti | |

OTHER PUBLICATIONS

International Search Report, dated Jan. 31, 2008, for International Application No. PCT/CA2007/001850, filed Oct. 19, 2007.

* cited by examiner

HAND LABELER

BACKGROUND OF THE INVENTION

The present invention relates to label applicators, and more particularly to a hand held label application mechanism for applying labels to items.

Hand labelers are well known for applying labels to items such as fruits, vegetables or other consumer goods. These labelers typically include a wheel that receives and holds a roll of labels, supported sequentially on a support liner, or web. The label web is advanced from the wheel through the labeler to an edge. The web is pulled over the edge to separate the labels from the support liner, allowing the labels to be deposited onto the items.

Although prior art labelers are generally acceptable, problems arise in a number of aspects of these labelers. For instance, it can be difficult to properly align the roll of labels in the labeler, such that each advancement of the label web results in the movement of one complete label to the edge. Multiple labels or partial labels often arrive at the edge, resulting in an item receiving too many labels, or no label at all. One solution to this problem is the use of a pin wheel for driving the label web. The pin wheel includes a plurality of protrusions that interfit with holes in the label web to drive the label web a desired distance for each rotation of the pin wheel. Unfortunately, however, pin wheels can lead to additional problems within the labeler, such as a jammed label web.

Additional problems with prior art label webs include a lack of storage for the waste support liner that has been separated from the labels, which can become tangled and obtrusive when hanging from the rear of the labeler, or create inefficiencies when users are forced to change or replace waste liner take-up reels.

As a result, manufacturers and users alike are continually striving for a cost efficient, hand-held label applicator that accurately and efficiently places labels onto items.

SUMMARY OF THE INVENTION

The present invention provides a hand held labeler having a support liner wheel that is driven by a motor to accurately advance the label web, while providing adequate storage for the support liner of an entire label web. The motor is connected to a micro-controller that controls the advancement of the label web to enhance accuracy.

In one embodiment, the labeler includes a label wheel supporting the label web, an applicator mechanism for applying labels to items, a support liner wheel receiving the support liner, a motor connected to the support liner wheel, the motor being actuatable to rotate the support liner wheel to pull the support liner onto the support liner wheel and to advance the label web from said label wheel, and a micro-controller for controlling the motor to vary the speed of the support liner wheel. The micro-controller controls the speed of the support liner wheel to accommodate for the increased speed of the label web as the circumference of the support liner grows on the support liner wheel. In one embodiment, a label sensor is included to signal the micro-controller when the web has advanced one label, and the micro-controller may be programmed to vary the speed of the support liner wheel as a function of label sensor's signal.

In one embodiment, the applicator mechanism includes an edge about which the label web is drawn to separate the labels from the support liner. The applicator mechanism may additionally include a trigger mechanism that is connected to the micro-controller, to signal the micro-controller that a label has been placed on an item. The micro-controller may be programmed to start the motor upon receiving the signal from the trigger mechanism. In one embodiment, the trigger mechanism includes a trigger roller and a trigger switch. The trigger roller may be movable between a first position and a second position when the roller engages and places a label on an item, and the trigger switch may be actuated by the movement of the trigger roller to send the signal to the micro-controller.

In another embodiment, the support liner wheel is sized to accommodate the support liner of an entire label web, such that the support liner wheel does not need to be emptied or replaced before depositing all of the labels of a particular label web. In one embodiment, the label wheel is sized to receive a roll of labels approximately five inches in diameter, and the support liner wheel is sized to accommodate the entire support liner of the five inch diameter wheel.

The present invention provides an efficient and accurate hand held labeler. The connection of the motor to the support liner wheel to pull the support liner and label web through the labeler reduces jamming of the web within the labeler, while the programming of the micro-controller to actuate the motor upon receiving a signal from the trigger mechanism, and to adjust the motor speed to accommodate for the changing size of the support liner on the support liner wheel increase accuracy in the placement of labels.

These and other objects, advantages, and features of the invention will be readily understood and appreciated by reference to the detailed description of the current embodiment and the drawings.

DETAILED DESCRIPTION OF THE CURRENT EMBODIMENT

Figure 1:
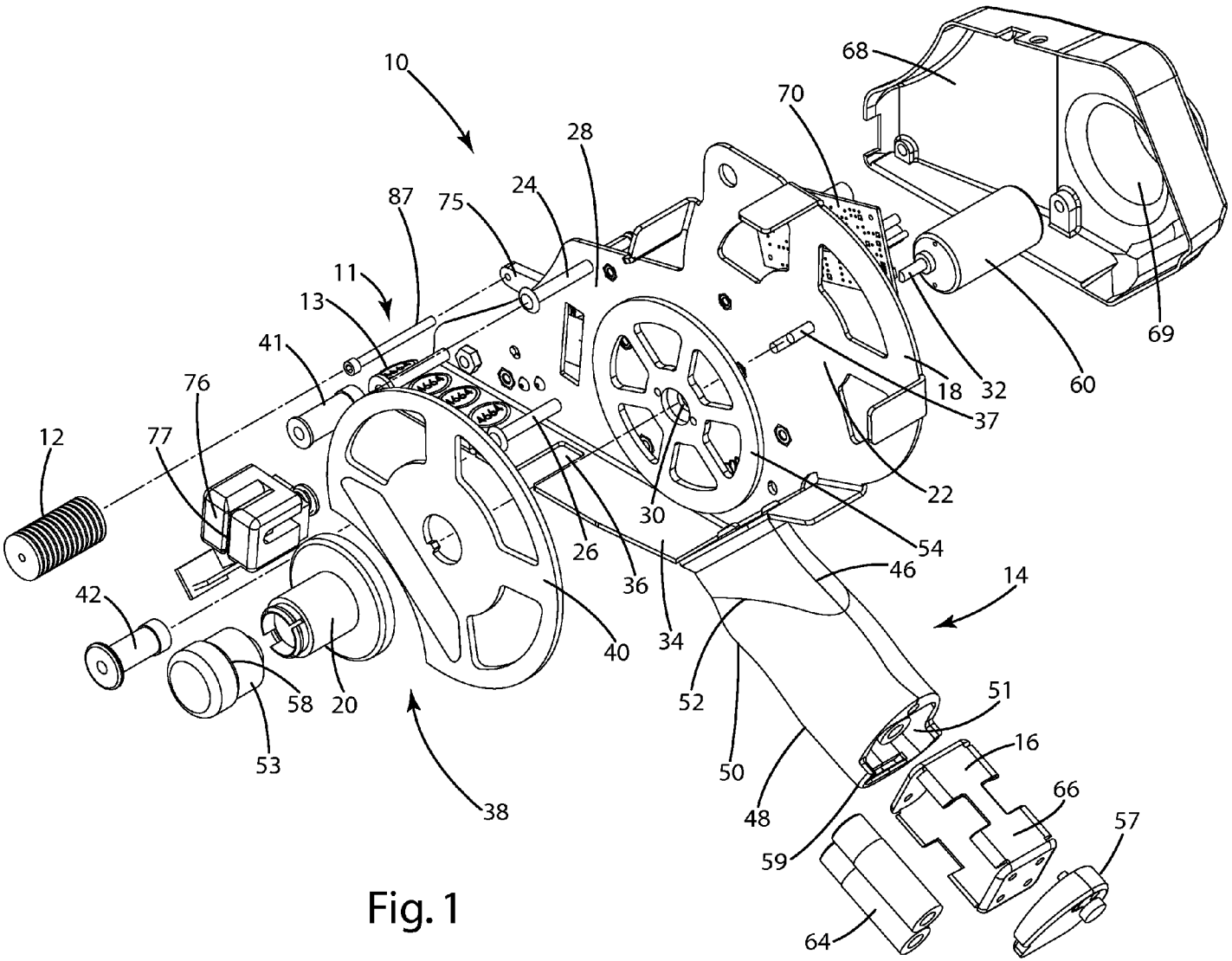
FIG. 1 is a left side exploded view of the labeler according to one embodiment of the present invention.

A hand labeler in accordance with one embodiment of the present invention is shown in FIG. 1 and generally designated 10. In one embodiment, the labeler 10 advances labels 13 on a label web 15 to an applicator 11 where they can be pressed or rolled onto products to be labeled. The labels 13 may be supported on a support liner 17 until they are deposited on the products. In one embodiment, the products to be labeled are soft products, such as produce. As illustrated, the labeler 10 includes an ergonomic handle 14 for holding the labeler, a removable battery pack 16 for powering the labeler and a housing 18. The housing 18 supports an assembly for holding and advancing a web of labels, and for a collecting and holding the waste support liner 17 after the labels 13 are removed.

I. Structure

The labels 13 to be applied by the labeler 10 are generally conventional, and therefore will not be shown or described in great detail. Suffice it to say that the labels 13 can be made of plastic, paper, edible material or a combination thereof in a wide variety of sizes and shapes. The labels 13 may include an adhesive, which may be approved as edible by the FDA. The labels 13 may be attached to a support liner 17 to be dispensed by lifting the labels from the liner, or alternatively the labels may be connected end-to-end without a liner. The label support liner 17 may be made of paper, plastic, an edible material or a combination thereof. In the illustrated embodiment, shown in FIG. 3, a web of labels 15 is provided in a roll on a label support liner 17. In one embodiment, the labels are pre-printed with information corresponding to the products to be labeled, however, in one embodiment, the labeler 10 may be equipped with an integral printer for printing information on blank or pre-printed labels while the labels are in motion or stationary. A variety of print technologies (not shown) may be used in this embodiment, such as 1) an electronic/thermal printer that activates a heat sensitive coating on the label surface; 2) a thermal transfer printer which transfers a colored or monochrome ribbon material onto the label surface by heat; 3) a colored or monochrome ink-jet printer; 4) a laser activated coating, using an optical laser to activate a heat and/or light sensitive coating surface that changes to colored or monochrome; 5) laser etching, using an optical laser to burn a heat and/or light sensitive coating on the label surface; or 6) a mechanical ink roller, using manually adjustable dies that transfer colored or monochrome ink from an ink supply, such as a sponge, to the labels.

The housing 18 may be made from a variety of materials, and is typically a molded thermoplastic or formed from a lightweight metal such as aluminum. It is sized to compactly support the components of the hand labeler 10 so that the entire unit can be easily held in one hand. As illustrated, the housing includes a label wheel 38 that extends from the housing 18. The label wheel 38 includes a label wheel post 20 that is substantially round and rotatably mounts over a post 37 that extends outwardly from a rear, upper portion 22 of the housing 18. A label wheel cover 40 removably attaches to the label wheel post 20. A label web 15 in roll formation (shown in FIG. 3) may be placed on the label wheel 38 by removing the label wheel cover 40 and placing the roll on the label wheel 38 and around the post 20. In one embodiment, the label wheel 38 is sized to accommodate up to a 5" diameter roll of labels on a label web, however, the size of the wheel 38 may vary from application to application. In the illustrated embodiment, a pair of roller posts 24 and 26 extend outwardly from a central portion 28 of the housing 18. Each of the roller posts 24, 26 receive a roller 41, 42 that may rotate about its respective post 24, 26. The housing further defines a hole 30 approximately in between the label wheel post 20 and the roller posts 24 and 26 for receiving the motor drive shaft 32 (discussed below). In addition, the housing includes a flange 34 that extends along the lower periphery of the housing 18. The flange 34 defines a notch 36 in the central portion 28 of the housing.

In one embodiment, the handle 14 extends from the housing 18. The handle 14 may be formed with the housing 18 as a single, unitary piece, or it may be formed from one or more pieces and attached to the housing. In the illustrated embodiment, the handle 14 is designed to comfortably fit the hand of a user. In this embodiment, the handle 14 includes a rear surface 46 with an outwardly curved shape to fit within the palm of the user's hand. The front surface 48 of the handle 14 also includes a curved surface, with an outward projection 50 that provides a rest for the index finger. A ridge 52 extends around the sides of the handle to provide a rest for the thumb. The shape of the handle 14 may vary depending on the desired comfort characteristics of the handle. In an alternative embodiment, at least a portion of the handle is coated with a grip material such as an elastomer, or includes a padded surface or a padded sleeve. In the illustrated embodiment, the handle 14 defines a space 51 inside the handle for receiving a battery pack 16 (described in more detail below). An end cap 57 removably attaches to the open bottom end 59 of the handle 14 to close the space 51 and retain the battery pack 16.

In the illustrated embodiment, the labeler 10 includes a label rewind wheel, or support liner wheel, 54 to collect the waste label liner after it has been separated from the labels. In one embodiment, the label rewind wheel 54 is sized to receive the entire waste liner from a 5" diameter web of labels, however, the size of the label wheel may vary from application to application. As shown, in this embodiment the label rewind wheel 54 is mounted to the housing with a support post 53 that is attached to the housing 18 over the hole 30. As shown in FIG. 1, the support post 53 is generally cylindrical, but includes a portion 58 that is tapered. The support post 53 is conventionally affixed to the housing 18, with the tapered portion 58 tapering toward the housing 18 to aid in holding the support liner 17 on the wheel 54. In one embodiment (not shown) the support liner wheel 54 may include a wheel cover that removably attaches to the label rewind wheel 54 to hold the waste support liner as it is wound on the label rewind wheel 54.

In one embodiment, the web 15 of labels 13 is advanced by the engagement of a motor 60 to the support liner wheel 54. As illustrated, in this embodiment the motor 60 is connected to the housing 18 on the opposite side as the post 53 such that the drive shaft 32 of the motor 60 extends through the hole 30 and engages the post 53. A variety of different motors 60 can be used, such as a DC brush or brushless motor, a stepper or servo motor, or another motor that is sufficient to rotate the label rewind wheel to pull the label web from the label wheel 38 and through the labeler 10. The drive shaft 32 may engage the post 53 directly, or via gears, a timing belt, an O-ring, or another known connection. In an alternative embodiment, the motor 60 may be positioned in other locations and the label web 15 may be advanced by other known methods, such as a pin wheel that engages the label support liner or a label web with no liner, or a pinch wheel. The motor 60 is supported by a rear cover 68 that defines an opening 69 for the motor 60.

Figure 4:
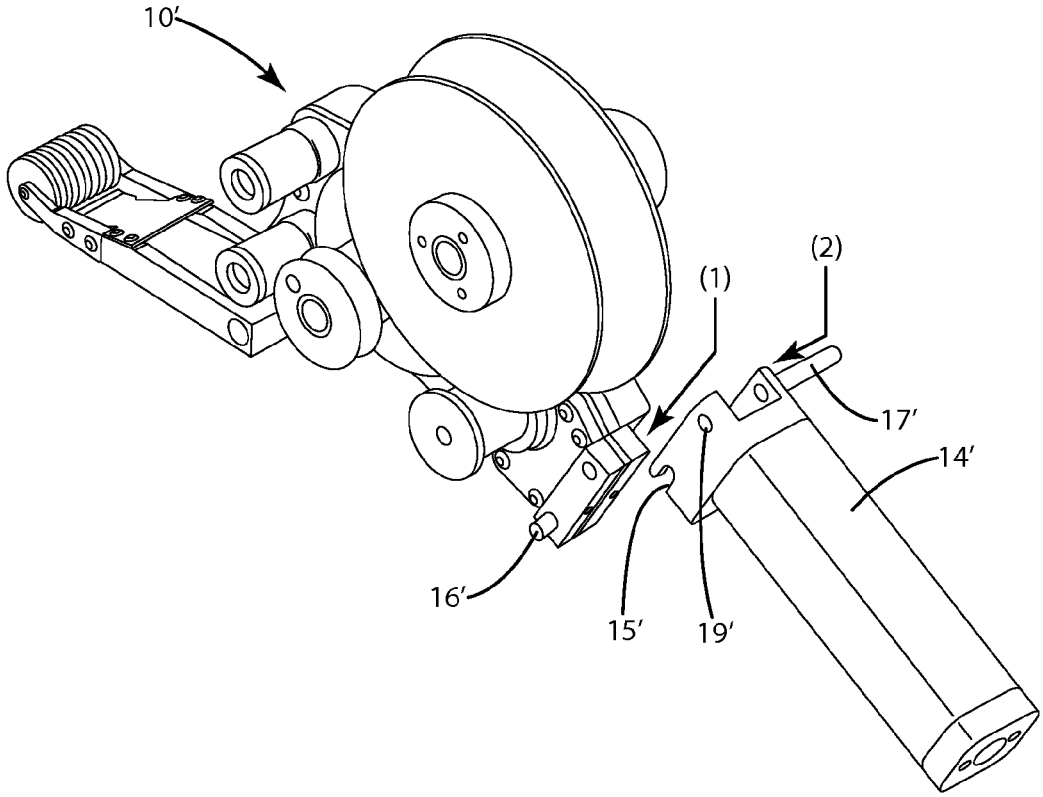
FIG. 4 is a perspective view of an alternative embodiment of the labeler including a removable handle and battery pack.

Power may be provided to the motor 60 by a battery pack, or an external power supply or both. In one embodiment, the labeler 10 includes a removable battery pack 16. The battery pack 16 includes one or more batteries 64, which may be Ni-MH, Lithium, Alkaline, NiCad, Gel Cell or another battery type. A variety of known battery pack styles may be used, depending on the application. In the illustrated embodiment, the battery pack 16 includes four batteries 64. In the illustrated embodiment, a battery housing 66 retains the batteries 64, and provides electrical connections for connecting the batteries 64 to the motor 60 when the pack 16 is inserted. In the illustrated embodiment, the removable battery pack 16 fits inside the space 51 in the bottom end 59 of the handle 14. Alternatively, as shown in FIG. 4, the batteries may be included in a removable handle 14'. In this alternative embodiment, which schematically represents the rest of the labeler 10', the upper edge of the handle 14' includes a groove 15' and the housing includes a pair or protrusions 16', such that the groove 15' can be fitted over the protrusions 16'. A pin 17' extends through holes 19' in the handle 14' and in the housing 18' to lock the handle 14' in place. In yet another alternative embodiment, the removable battery pack can clip onto, slide into or be built into another portion of the labeler 10.

A power switch 71 may be mounted on the rear of cover 68 of the housing 18 and is electrically connected to the motor 60 by conventional means. The power switch may include an indicator LED 73. The power switch is additionally connected to a micro-controller 70, a label sensor 72, and a trigger switch 74. The micro-controller 70 is programmed to selectively activate the motor 60. The label sensor 72 is one of a variety of electrical sensors, such as an optical sensor, a capacitive sensor, or a laser sensor, that is mounted to the labeler 10 such that it can detect the advancement of the label web 15. In one embodiment, shown in FIG. 1, the label sensor 72 is mounted on a label sensor mount 76 that is attached to the housing 18. In the illustrated embodiment, shown in FIGS. 1-3, the housing 18 includes a slot receptacle 77 that receives the label sensor 72 and aligns the label sensor 72 with a portion of the label web. The label sensor 72 may, however, be mounted to other locations on the labeler, such as the label rewind wheel 54. The label sensor 72 is programmed to detect individual labels, for instance by detecting the space between individual labels, perforations in the labels or the label support liner, different label textures or different light conditions (i.e. opaque labels/transparent support liner). In one embodiment, a sensor cover (not shown) is provided to shield the label sensor 72 from ambient light. The sensor cover may be a U-shaped piece of opaque material, such as plastic, that attaches to the roller posts 24 and 26 to substantially shield the label sensor 72. In the illustrated embodiment, a pair of flaps or brushes 90, 91 extend downwardly from the label sensor housing 76. The flaps 90, 91 converge towards each other, such that they both engage the label web extending through the slot 77 in the housing 76. The flaps 90, 91 provide tension to the label web 15 to aid in the separation of the labels 13 from the web 15 as the web 15 is pulled over the edge 84 as described below.

The labeler 10 additionally includes a trigger mechanism, also known as an applicator mechanism, for advancing and/or applying labels to products. In one embodiment, the trigger mechanism is comprised of a trigger roller 12, a tension roller 82 and an edge 84 on the flange 34. Shown in FIGS. 1-3, the tension roller 82 is mounted to the housing 18 approximately above the front edge 84 of the flange 34. The tension roller 82 may attach over a rod 83 that is mounted to a U-shaped extension 85 of the flange 34. The tension roller 82 puts tension on the web of labels and holds the web 15 on or near the flange 34. As shown, the trigger roller 12 is connected to a trigger lever 75. The lever 75 is pivotally connected to the housing 18 such that the trigger roller 12 and the arm 75 can move when the roller 12 is pressed against a product. Alternatively, the trigger roller 12 may be connected to the tension roller 82. As illustrated, the trigger roller 12 is mounted over a rod 87 connected to the arm 75. The trigger roller 12 provides a generally soft material for rolling and/or pressing a label onto a product. In one embodiment, the trigger roller 12 is constructed of silicon rubber to prevent labels from sticking to the roller, and to prevent the build up of fruit juice on the roller 12. As shown, the roller 12 is comprised of a plurality of round disks that can roll over the product surface. Alternatively, the roller 12 could be a solid piece, or the roller 12 could be substituted for a flexible wiper blade or fingers.

Figure 2:
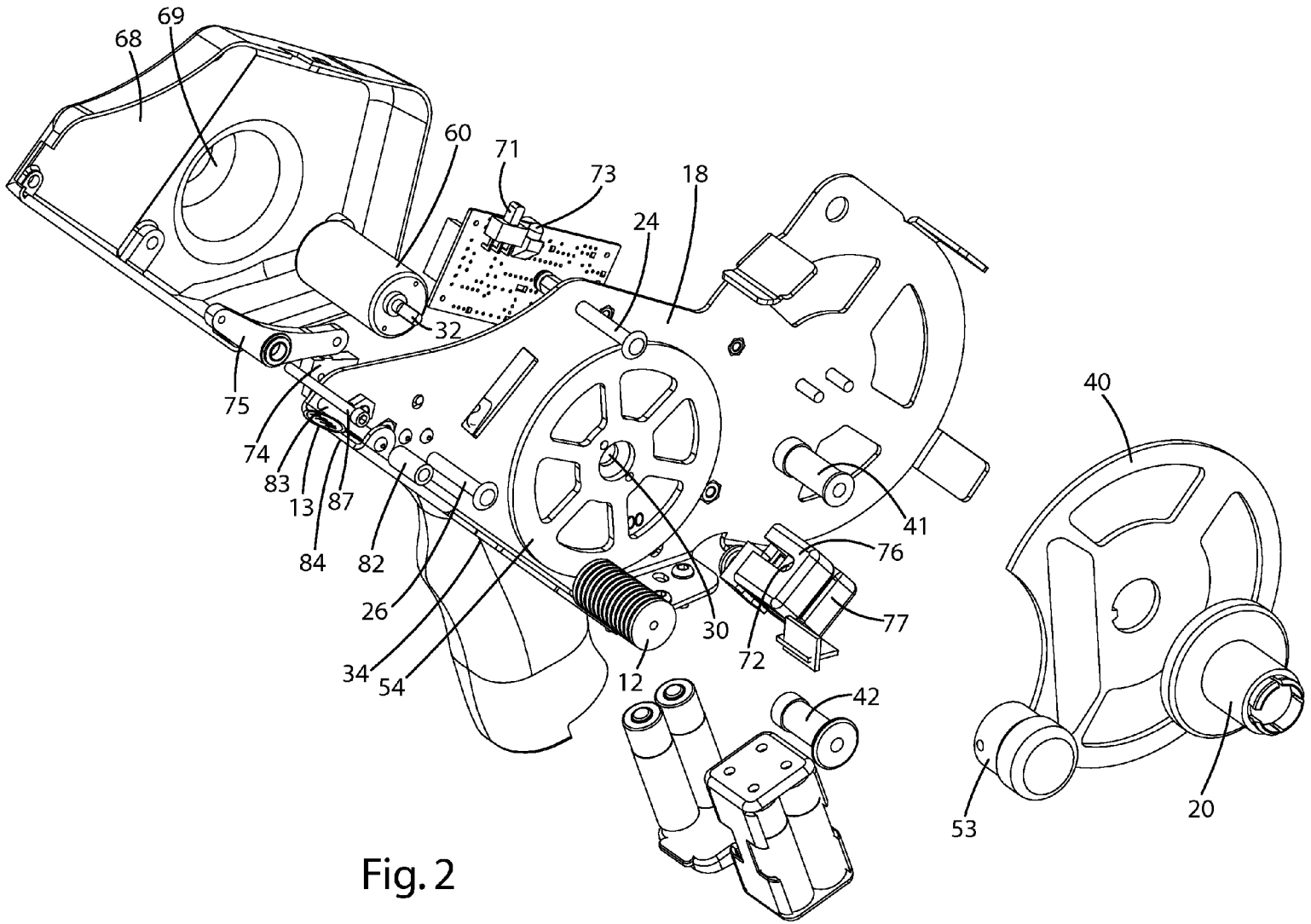
FIG. 2 is a right side exploded view thereof.
Figure 3:
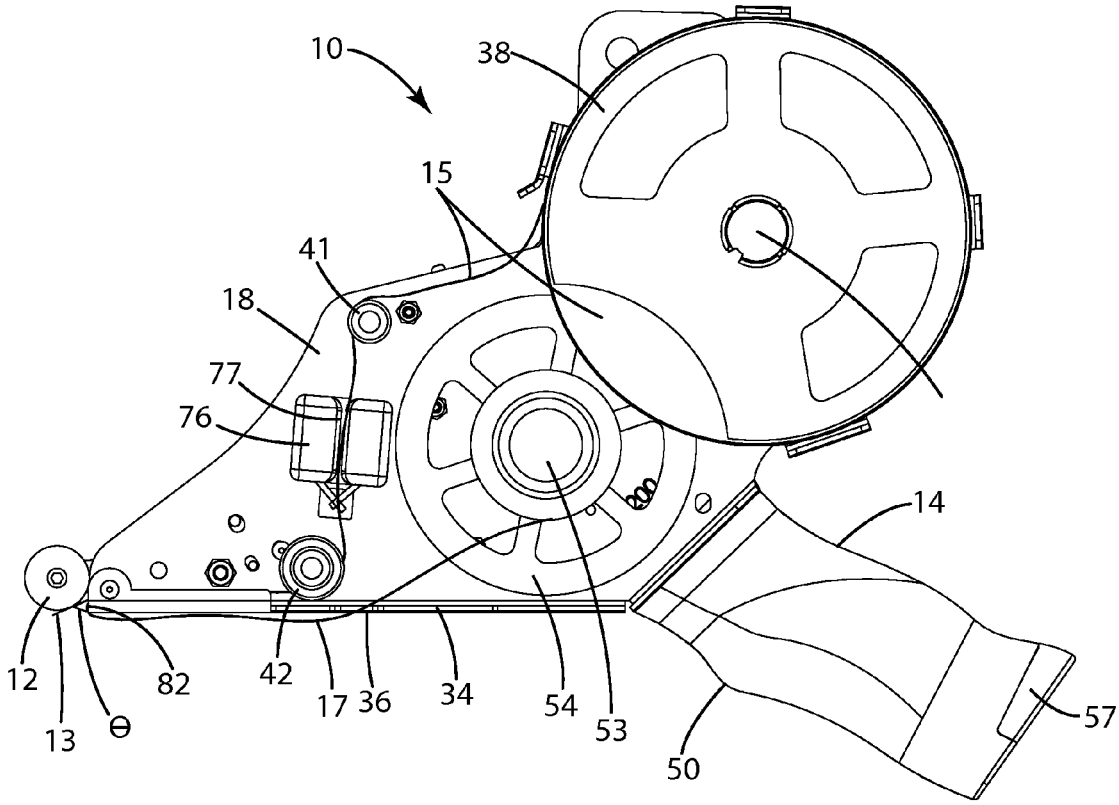
FIG. 3 is a left side view of the labeler thereof.

As shown in FIGS. 1-3, in one embodiment, the flange 34 extends generally in a plane, and the front edge 84 extends generally in the same plane as the flange 34. In this embodiment, as the label web 15 extends over the edge 84 and the labels 13 peel away from the support liner 17, the label 13 extending beyond the edge 84 and under the trigger roller 12 tends to extend at about an angle θ from the plane of the flange 34. In an alternative embodiment (not shown), a portion of the flange 34, including the edge 84, may be angled upwardly from the rest of the flange 34, for example, at an angle approximately equal to the angle θ, such that the label 13 extending beyond the edge 84 extends approximately in the same plane as the flange 34. This embodiment could make the placement of labels on the items easier, because the labels would extend approximately parallel to the surface of the items to be labeled.

In one embodiment, a trigger switch 74 is activated by pressing the trigger roller 12 onto the product. The trigger switch 74 may signal the motor 60, or micro-controller 70 as discussed below, to start in order to index the web 15 of labels 13. In the illustrated embodiment, the trigger switch 74 is a mechanical switch. The mechanical switch is mounted to the housing 18 adjacent to the tension roller 82. As shown, the switch 74 is activated by movement of the trigger lever 75 when the trigger roller 12 is pressed against a product. The switch 74 may be otherwise activated by movement of the tension roller 82, or the switch 74 could be mounted in a different location, such as on the tension roller 82. In yet another embodiment, the trigger switch can be an electronic sensor that senses the movement of the trigger lever 75, the tension roller 82. The sensor could be an optical sensor, a capacitive sensor, a laser or another known sensor. In yet another embodiment, the electronic sensor could signal the micro-controller when it detects the presence of a product, for instance, by sensing the proximity to the product.

II. Operation

In operation, a label web 15 must first be threaded into the labeler 10. In one embodiment, shown in FIG. 3, the label web 15, including a label support liner 17 is wound through the labeler 10. As shown, a roll of labels 15 is placed on the label wheel 38. The label web is threaded over a first roller 41; through the slot 77 in the label sensor housing 76; under a second roller 42; around the front edge 84 of the flange 34 (where the labels 13 are separated from the support liner 17); through the notch 36 in the flange 34; and onto the support liner wheel 54, where it may extend into a slot (not shown) or be held in place manually or with adhesive. In this embodiment, when the label rewind wheel 54 is rotated, the label web 15 is pulled from the label wheel 38 and over the edge 82, wherein the labels are removed from the support liner 17 to extend under the trigger roller 12 where they are deposited onto products. The support liner 17 is further pulled onto the label rewind wheel 54, and is held in place on the support post 53 by the tapered portion 58 as it winds onto the wheel 54. When the entire amount of labels has been used, the waste liner 17 on the label rewind wheel 54 can be removed and discarded.

The use of the labeler 10, and the labeling operation, starts when the power switch 71 is turned on and a label 13 is pressed onto a product. When a label 13 is pressed onto a product, the trigger roller 12 and lever arm 75 are caused to move, causing the trigger switch 74 to signal the micro-controller 70. Upon receiving the signal from the trigger switch 74, the micro-controller 70 activates the motor 60 to begin indexing the label web 15. In this way, the subsequent label is advanced to the trigger roller 12 such that it can be deposited. The label sensor 72 is programmed to send a signal to the micro-controller 70 when one label has moved past the sensor 72, such that the micro-controller can signal the motor 60 to stop. The micro-controller is additionally programmed to look for a signal from the label sensor 72 for a period of time, and to stop the motor 60 and signal the LED 73 to flash if no signal is received, in order to indicate that the labels are out or the support liner 17 is jammed.

Figure 5:
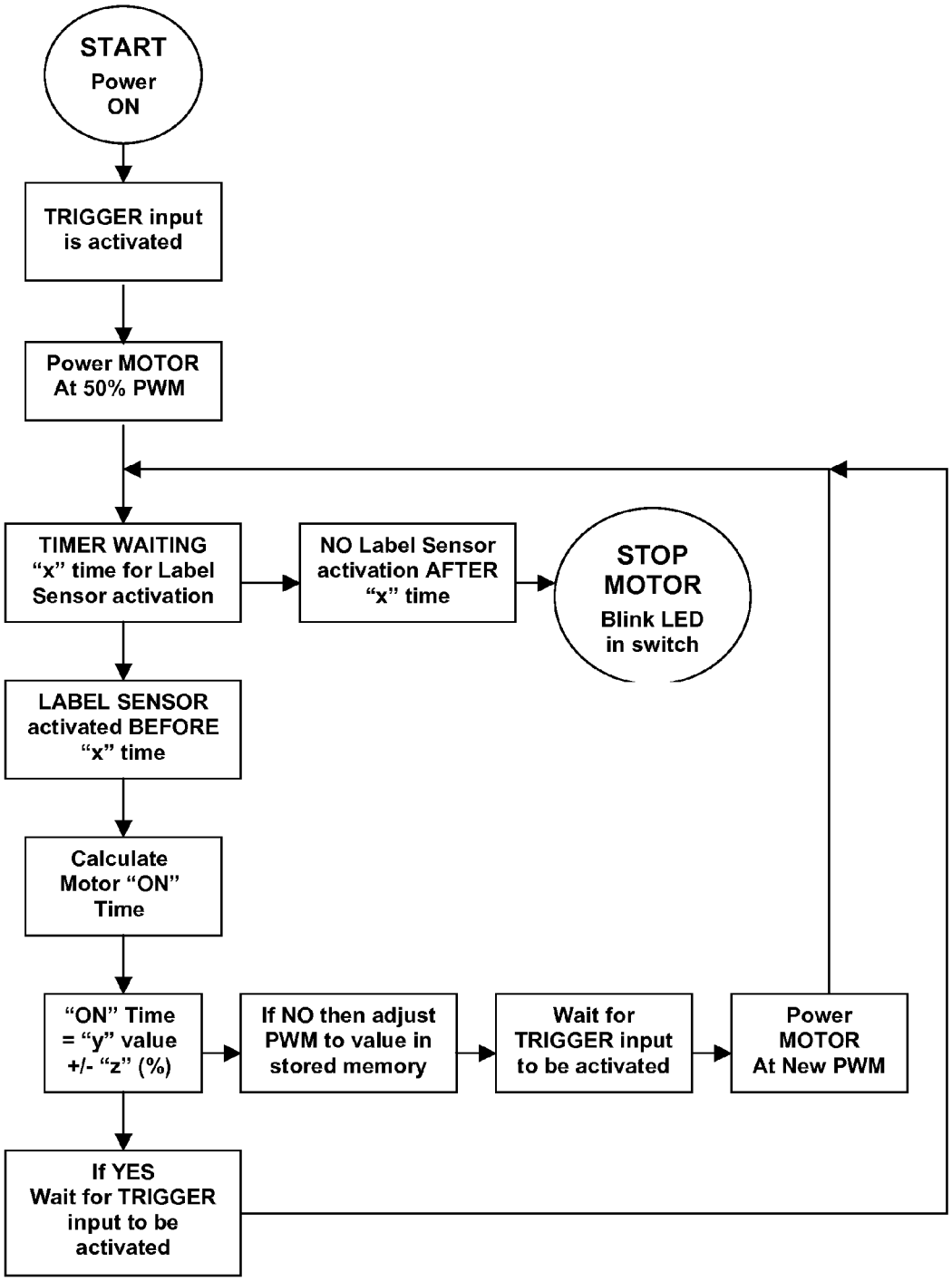
FIG. 5 is a flow chart of the micro-controller operation according to one embodiment.

In the illustrated embodiment, wherein the motor 60 is engaged with the label rewind wheel 54 to drive the label wheel 38, the micro-controller 70 is additionally programmed to accommodate for the change in speed of the advancing label web 15 as the circumference of the support liner 17 on the label rewind wheel 54 increases. A flow chart generally depicting the program of the micro-controller 70 in this embodiment is shown in FIG. 5. In one embodiment, the motor is a pulse-with modulation (PWM) motor activated at 50% PWM, however, as noted above other motors, such as stepper motors, may also be used. As depicted in FIG. 5, the motor is a PWM motor, where the speed of the motor is varied by changing the PWM. As shown, the program is initiated when a user turns the power on. With the power on, the trigger switch is activated when a label is deposited. The micro-controller receives the signal from the trigger switch, and activates the motor to operate at a pre-determined speed. As the motor is operated, the micro-controller waits for a pre-determined time "x" for a signal from the label sensor. If no signal is received, the micro-controller stops the motor and the LED blinks. If a signal is received from the label sensor, then the micro-controller stops the motor and calculates the amount of time that the motor was on (i.e. the label index time). If the label index time is equal to a pre-determined "y" value, plus or minus a pre-determined "z" percentage of the "y" value, then the micro-controller waits for the next input from the trigger switch. If the label index time is not within the range of the "y" value plus or minus the "z" percentage, then the speed of the motor is adjusted to another value and stored in the memory. At the subsequent signal from the trigger switch, the motor operates at the new speed.

In another embodiment, the micro-controller is additionally programmed to blink the LED when the power source falls below a pre-determined voltage. The program could provide for the LED to blink rapidly for a short time, and then power the system off.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A labeler comprising:

a housing including a handle extending from said housing;

a label web, said label web including a plurality of labels supported on a support liner;

a label web support extending from said housing, said label web support rotatably supporting said label web;

an applicator extending from said housing, said applicator separating said labels from said support liner;

a motor supported on said housing, said motor capable of selectively advancing said label web to move one of said labels to said applicator; and a support liner wheel extending from said housing, said support liner wheel receiving said support liner, said support liner wheel sized to receive said entire support liner of said label web, wherein said motor is connected to said support liner wheel to rotate said support liner wheel, wherein the labeler includes a micro-controller connected to said motor, said micro-controller programmed to vary the speed of said support liner wheel, wherein said applicator includes a trigger switch connected to said micro-controller, said trigger switch capable of being actuated to turn on said motor, the labeler including a sensor supported on said housing, said sensor sensing movement of one of said labels on said label web, said micro-controller connected to said sensor and programmed to determine a label index time, and to control the power output of said motor as a function of said label index time.

2. The labeler of claim 1 wherein said micro-controller is programmed to change the speed of said support liner wheel as said label index time changes.

3. The labeler of claim 2 wherein said micro-controller is programmed to decrease the speed of said support liner wheel as said label index time increases.

4. The labeler of claim 3 including an indicator connected to said micro-controller, said micro-controller programmed to activate said indicator if said sensor does not sense movement of said labels.

5. The labeler of claim 4 wherein said sensor is supported on a sensor housing, said sensor housing defining a slot to receive said label web, said sensor housing including a tensioning element mounted on said sensor housing adjacent said slot.

6. The labeler of claim 5 wherein said tensioning element includes a pair of brushes extending from said sensor housing, said brushes converging toward each other.

7. The labeler of claim 6 wherein said support liner wheel includes a plate and a shaft extending from said plate, said shaft tapered to wind said liner toward said plate, said support liner extending around said tapered shaft.

8. A labeling apparatus for placing labels from a label web onto items, the web including a plurality of labels and a support liner, the labeling apparatus comprising:

a label wheel supporting the label web;

an applicator mechanism for applying labels to the items;

a support liner wheel receiving said support liner;

a motor connected to said support liner wheel, said motor being actuatable to rotate said support liner wheel to pull said support liner onto said support liner wheel and to advance said label web from said label wheel; and controller means for controlling the motor to vary the speed of the support liner wheel, wherein said controller means includes a micro-controller and a label sensor, said label sensor capable of signaling said micro-controller when one of the labels on the label web moves past said sensor, said micro-controller connected to said motor and programmed to adjust said speed of said motor as a function of said signal.

9. The labeling apparatus of claim 8 wherein said motor operates at a pulse-width modulation, said micro-controller programmed to determine a label index time based on said signal, said micro-controller programmed to decrease said pulse-width modulation as said label index time increases.

10. The labeling apparatus of claim 9 wherein said sensor is supported on a sensor housing, said sensor housing defining a slot to receive the label web, said sensor housing including a tensioning element mounted on said sensor housing adjacent said slot.

11. The labeling apparatus of claim 10 wherein said tensioning element includes a pair of brushes extending from said sensor housing, said brushes converging to engage each other.

12. The labeling apparatus of claim 11 wherein said support liner wheel includes a plate and a shaft extending from said plate, said shaft tapered to wind said liner toward said plate, the support liner extending around said tapered shaft.

13. The labeling apparatus of claim 12 including a trigger switch connected to said micro-controller, said trigger switch capable of being actuated to turn on said motor.

14. The labeling apparatus of claim 13 wherein said applicator includes a trigger roller that is movable between a first position and a second position, wherein said trigger switch is actuated by movement of said trigger roller from said first position to said second position.

* * * * *